US006687932B1

(12) United States Patent
Bangert et al.

(10) Patent No.: US 6,687,932 B1
(45) Date of Patent: Feb. 10, 2004

(54) ADJUSTING DEVICE WHICH IS PROVIDED FOR PIVOTING A PIVOTAL ELEMENT OF A PIECE OF FURNITURE IN RELATION TO A FIXED ELEMENT OF THE SAME

(75) Inventors: Christian Bangert, Suhl (DE); Stefan Hessler, Suhl (DE); Ingo Uhlenhaut, Suhl (DE)

(73) Assignee: Linator GmbH, Suhl (DE)

( * ) Notice: Subject to any disclaimer, the term of this patent is extended or adjusted under 35 U.S.C. 154(b) by 0 days.

(21) Appl. No.: 10/009,942

(22) PCT Filed: May 8, 2000

(86) PCT No.: PCT/DE00/01433

§ 371 (c)(1),
(2), (4) Date: Nov. 7, 2001

(87) PCT Pub. No.: WO00/67617

PCT Pub. Date: Nov. 16, 2000

(51) Int. Cl.[7] ..... A47C 20/04; A61G 7/015
(52) U.S. Cl. ..... 5/617; 5/618
(58) Field of Search ..... 5/617, 618, 600, 5/613, 616

(56) References Cited

U.S. PATENT DOCUMENTS 5,542,744 A 8/1996 Bathrick

FOREIGN PATENT DOCUMENTS

| | | |
|---|---|---|
| DE | 05 23 26 709 | 12/1974 |
| DE | 42 11 352 C2 | 10/1993 |
| DE | GEB 93 07 322.4 | 10/1993 |
| DE | 295 12 054 U1 | 9/1995 |
| DE | 05 44 33 934 A1 | 3/1996 |
| EP | 0 315 438 A1 | 5/1989 |
| EP | 0 518 446 A1 | 12/1992 |

*Primary Examiner*—Alexander Grosz
(74) *Attorney, Agent, or Firm*—Thomas R. Vigil; Welsh & Katz, Ltd.

(57) ABSTRACT

The invention relates to an adjusting device which is provided for pivoting a pivotal element of a piece of furniture in relation to a fixed element of the same, said furniture being used in households, work areas and in health care fields. The inventive device comprises a retaining arm (16), an actuating drive (24) held on said retaining arm (16), and an actuating arm (26), whereby the retaining arm (16) and the actuating arm (26) can be moved in relation to one another by the actuating drive (24). The adjusting device (10) is held on the fixed element (18) via a free end of the retaining arm (16) and is held on the pivotal element (12) via a free end of the actuating arm (26). The actuating arm (26) is pivotally connected, via the end thereof situated opposite the free end, to the retaining arm (16).

19 Claims, 7 Drawing Sheets

ADJUSTING DEVICE WHICH IS PROVIDED FOR PIVOTING A PIVOTAL ELEMENT OF A PIECE OF FURNITURE IN RELATION TO A FIXED ELEMENT OF THE SAME

The present invention relates to an adjusting device for pivoting a pivotal element of the piece of furniture. The piece of furniture is used in living and working areas of a home or in a sanatorium or health spa.

Such adjusting devices are utilized on beds whose headrest and/or leg part is adjustable in height for example for the purpose of meeting the individual ideas of the user. Its utilization on armchairs, cupboards or other pieces of furniture is conceivable as well.

In the adjusting devices disclosed for example in the German Patents DE 44 33 934 A1 or DE 42 11 352 C2 or in the German published application DE-OS 23 26 709, a spindle is attached to a lever arm which is accommodated on a torsion bar in order raise the headrest or the leg part by way of said torsion bar. The torsion bar is thereby arranged in the axis of rotation of the headrest or leg part. The torsion bars to be used have to be capable of transmitting the high rotation and torsion moments of more than 500 nm that occur thereby and are to be designed accordingly and preferably be made from metal. Such a device requires expensive fittings and is difficult to retrofit on already existing beds.

The German Utility Model DE-G 93 07 322.4 describes a retrofittable, motor driven lifting apparatus for moving headrest and/or leg parts of a supporting framework of a bed in which a cross-beam that holds a driving motor and a scissor-type rod assembly is placed onto the frame of the supporting framework. The upper, free side of the scissor-type rod assembly is guided in a guide beam and is fastened to the headrest or leg part of the supporting framework. The scissor-type rod assembly and, as a result thereof, the headrest or leg part, are moved through a spindle that connects the two shear elements and through an actuating drive that displaces the spindle in axial direction. The arrangement of the spindle effects that, on account of the dead weight of the headrest or leg part, or of the person resting thereon, said spindle is mainly loaded in tension. In contrast to the previously described prior art, the lifting apparatus according to the German Utility Model DE-G 93 07 322.4 substantially transmits tensile and pressure loads onto the supporting framework and onto the proper headrest part, whereas the bending moments transmitted are negligible and may be absorbed by the existing supporting framework or headrest part without the need for reinforcing the same by means of expensive fittings.

The lifting apparatus according to the German Utility Model DE-G 93 07 322.4 consists of many complicated individual pieces that moreover are to be manufactured with large dimensions in order to be capable of diverting the loads. Furthermore, the scissor-type rod assembly involves the risk that objects or body parts such as arms or legs get caught therein in the process of traveling the headrest or leg part, thus causing damage or even injury.

In view thereof it is the object of the present invention to provide an adjusting device that may be easily mounted to any type of mattress frames without having to install expensive fittings and that minimizes the risk of injury.

The technical solution in accordance with the present invention consists in proposing an adjusting device having the features of claim 1. Advantageous developments of this adjusting device are to be found in the subordinate claims.

The adjusting device in accordance with the invention has the advantage that it only needs to be fastened to the piece of furniture at two or three points so that the adjusting device is almost cantilevered. Accordingly, both the pivotal and the retaining arm may be easily fastened to the piece of furniture without the help of fittings, this being the reason why the adjusting device may be utilized without great expenditure in the manufacture of supporting frameworks and why it is possible to retrofit already existing supporting frameworks at low cost.

Another advantage is that the risk of injury with the adjusting device according to the invention is very low since, in this case, there are merely two arms moving relative to one another and since the retaining arm and the actuating arm project from the cross-beam of the supporting framework into the inside of the piece of furniture, more specifically into a free space located underneath the supporting framework. As a result thereof, the adjusting device is hardly visible and accessible from the outside so that the adjusting device is protected against accidental damages as well.

Still another advantage is that the cost of production is low as there are few movable parts. As a result thereof, the dead weight could also be reduced, which permits to further save material and cost.

The advantage of having retaining arm and actuating arm arranged on one plane is that the space needed is kept small so that the adjusting device may also be mounted in small pieces of furniture or in pieces of furniture that have only little mounting space available.

In a preferred embodiment, the actuating drive is held on a retaining arm that is rigidly fastened to the piece of furniture, thus making certain of simple installation and low-cost manufacture.

On a retaining arm which is rigidly mounted on the fixed element, the free end of the actuating arm moves on an orbit that needs not be identical to the orbit of the headrest part. To compensate this difference, the actuating arm is advantageously held on the pivotal element, or on the headrest part respectively, by means of a length compensating device. This length compensating device may be a long hole for example.

In a preferred embodiment, this length compensating device is dispensed with, the retaining arm being also pivotally arranged on the fixed element instead. As the retaining arm is now pivotal as well, the actuating arm is capable of moving the entire adjusting device up- or downward within certain limits when it is moved upward for the purpose of compensating the differential orbits of actuating arm and headrest part. Concurrently, as a result thereof, the adjusting device only transmits tensile and pressure loads onto the supporting framework and the headrest part, and the rotation and torsion moments that wear the material are not occurring any longer. Accordingly, the forces emanating from the adjusting device in accordance with the invention may be absorbed and transmitted by commercially available supporting frameworks without the need for expensive or additional fittings or other material reinforcing pieces.

Still another advantage of the adjusting device is that, since the actuating arm is arranged across the main direction of movement, the adjusting device may be arranged simply and without any additional tools on the pivotal element, said adjusting device extending far into the inside of the piece of furniture, thus preventing the adjusting device from causing injury to the user or damage to the material.

As only few component parts are needed, the friction between the parts is reduced. Accordingly, a smaller driving motor may be chosen which in turn further lowers the cost.

Still another advantage is that the adjusting device in accordance with the invention may easily be retrofitted on already existing supporting frameworks, since merely the retaining arm needs to be arranged either rigidly or pivotally on the cross-beam of the supporting framework (of the fixed element) and since the actuating arm merely needs to be arranged pivotally on the cross-beam of the headrest part (pivotal element). As a result thereof, it is possible for an amateur mechanic to mount the adjusting device in accordance with the invention to already existing supporting frameworks.

In a particularly preferred embodiment, the actuating drive is pivotally held on the retaining arm or on the piece of furniture by way of a holding device. The advantage thereof is that the circular motion executed by the end of the actuating arm facing the spindle on being pivoted is retraced by the spindle and the entire actuating drive so that the normally occurring transverse loads which act on the actuating drive do not arise as a result thereof. On one side, this leads to a much smaller size of the individual component parts of the actuating drive and of the adjusting device, and accordingly, to reduction of cost and on the other to longer work life since the transverse loads that damage the device do not occur any longer.

In order to provide a reliable holding device that moreover permits a pivotal movement of the actuating drive, it proved advantageous to provide at least one jib with a spherical or cylindrical end that engages into a corresponding recess arranged on the actuating drive. Thanks to the spherical or cylindrical shape of the free jib end, said jib may be retained in the recess and still be pivoted.

In a preferred development, it proved advantageous to extend the recess radially away from the axis of the spindle. When more specifically two such recesses are arranged directly opposite one another, the actuating drive may easily be pivoted about the thus formed pivot axis while still being reliably retained.

In a preferred development, the recess surrounds more than 180 degrees of the spherical or cylindrical end of the jib. As a result thereof, the jib is positively fastened in the recess so that the actuating drive is prevented from accidentally slipping out.

In another advantageous embodiment there is provided a friction clutch between actuating arm and retaining arm. This constructional separation between actuating arm and retaining arm interrupts the flow of forces from the driving motor to the pivotal element. This signifies that, in the event an obstacle gets caught between headrest part and supporting frame when lowering for example the headrest part, the actuating drive continues to be moved, but the force that emanates from the driving motor is not transmitted to the obstacle as this is prevented from happening on account of the separation between actuating arm and retaining arm. The obstacle is thus prevented from being damaged and the operator from being injured.

The friction clutch advantageously comprises a catch carried on the spindle and serving to rotatably receive the actuating arm, the front side thereof, which is turned away from the housing, being undulated and being engageable with a buffer which is located at the end of the spindle and is also given a corresponding undulated shape. The advantage thereof is that the loaded actuating arm presses the undulated front side of the catch against that side of the buffer that is given the corresponding undulated shape so that, on account of this positive connection, the spindle is reliably prevented from rotating in unison therewith. The normally used locking to prevent twisting of the spindle is no longer necessary as a result thereof.

Furthermore, the present invention is based on the appreciation that the actuating drive of the adjusting device must absorb very large axial forces in order to be capable of adjusting the element to be adjusted, more specifically when a person is resting thereon, and that the radial forces occurring thereby are much smaller.

A particularly preferred embodiment is characterized by an actuating drive with a driving motor whose driven shaft is configured as a worm, with a spindle that is held in a worm wheel in such a manner that it is axially movable, the worm meshing with the worm wheel, and with a housing that carries the driving motor and rotatably accommodates the worm wheel, wherein, between worm wheel and housing, there is provided at least one needle bearing for absorbing the axial forces and at least one sliding bearing for absorbing the radial forces.

An actuating drive configured in accordance with this technical teaching has the advantage that the needle bearing can reliably absorb the high axial forces that occur without any damage and that the small forces may also be sufficiently absorbed by a low-cost sliding bearing. I.e., the present invention permits to substitute a less expensive needle bearing and an even less expensive sliding bearing for the expensive prior art ball bearing. Concurrently, as the needle and/or the sliding bearing require only little place, the housing may be given accordingly smaller dimensions, which contributes in saving costs.

In a preferred embodiment, two spaced apart sliding bearings are provided in the actuating drive. The advantage thereof is that, on pivoting the actuating arm, possibly occurring transverse loads may better be diverted on account of the favorable lifting conditions. Another advantage is that, thanks to the spacing of the two sliding bearings, the forces occurring on pivoting the actuating arm are transmitted onto the actuating drive through the sliding bearings and not through the very spindle. As a result thereof, the susceptible spindle and the susceptible worm wheel are less exposed, which leads to a longer work life.

The recesses for receiving a jib of a holding device that are arranged opposite one another on the housing in such a way that they extend radially from the axis of the spindle have the advantage that the actuating drive may be pivoted about the pivot axis formed by the recess as a result thereof, thus making certain of a reliable hold and a controlled pivotal movement.

In another preferred development, the recess surrounds more than 180 degrees of the spherical or cylindrical end of the jib, thus providing a positive connection between actuating drive and holding device out of which the actuating drive cannot be released without the use of force.

Further advantages of the adjusting device according to the invention will become apparent in the annexed drawing and in the following description of embodiments. The respective one of the above mentioned features and of those that will be explained later can be used alone or in any combination in accordance with the invention. The embodiments mentioned are only examples and are not limiting the scope of the invention.

Figure 1:
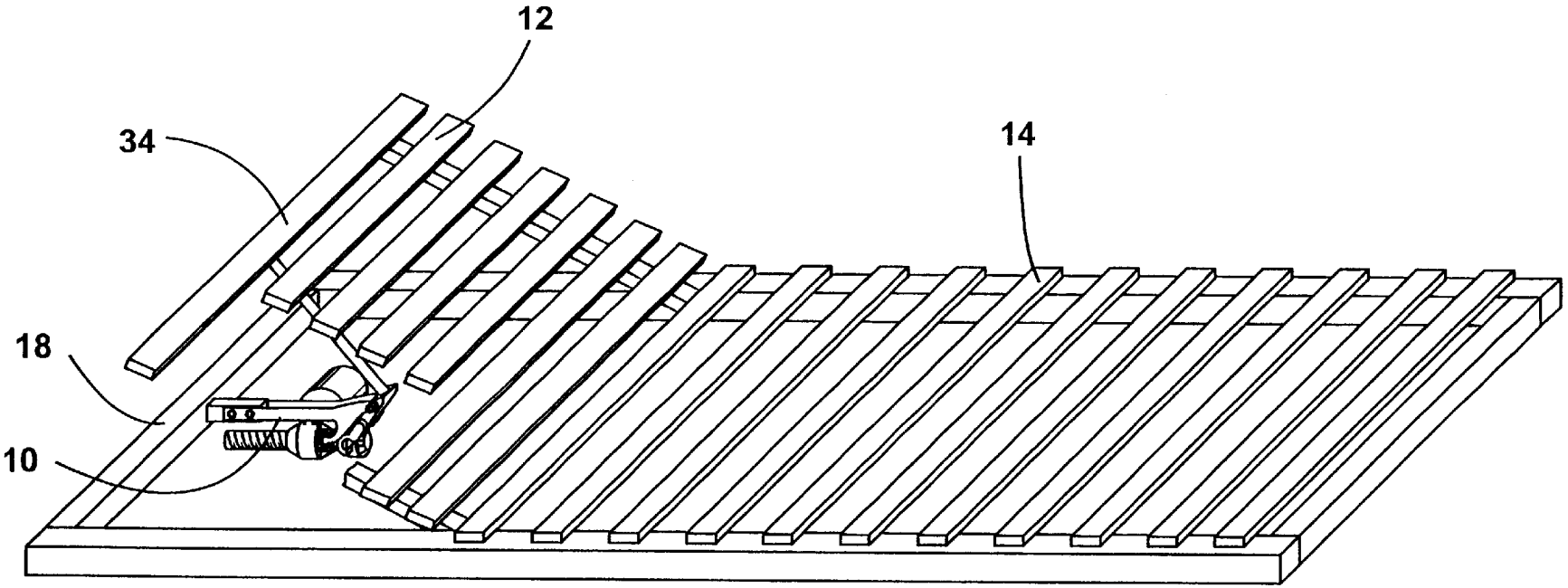
FIG. 1 is a perspective view of a supporting framework of a bed with a first adjusting device in accordance with the invention.

The FIGS. 1 through 5 depict a first embodiment of an adjusting device 10 according to the invention as it is utilized to adjust a headrest part 12 and/or a leg part of a supporting framework 14 of a bed that is not illustrated herein. The headrest part 12 thereby constitutes the pivotal element and a cross-beam 18 of the supporting framework 14 the fixed element of the piece of furniture configured as bed. Said adjusting device 10 is rigidly screwed onto a cross-beam 18 of the supporting framework 14 by way of a retaining arm 16. Said retaining arm 16, which is composed of two cheeks 20, 22, carries an actuating drive 24 arranged underneath the retaining arm 16 on one side and an actuating arm 26 that is arranged above the retaining arm 16 and is pivotally carried on the retaining arm 16 on the other. The actuating arm 26 thereby engages a catch 28 that is guided on a spindle 30 of the actuating drive 24 in such a manner that it is freely slidable in axial direction. The actuating arm 26 is thus operatively connected to the actuating drive 24 and can be pivoted into the desired direction to bring the headrest part 12 into the desired position by operating the actuating drive. By means of merely a simple screw, the actuating arm 26 is thereby screwed on the cross-beam 18 of the headrest part 12 by way of an angular metal sheet 32 in such a manner that it is pivotally carried thereon.

Figure 2:
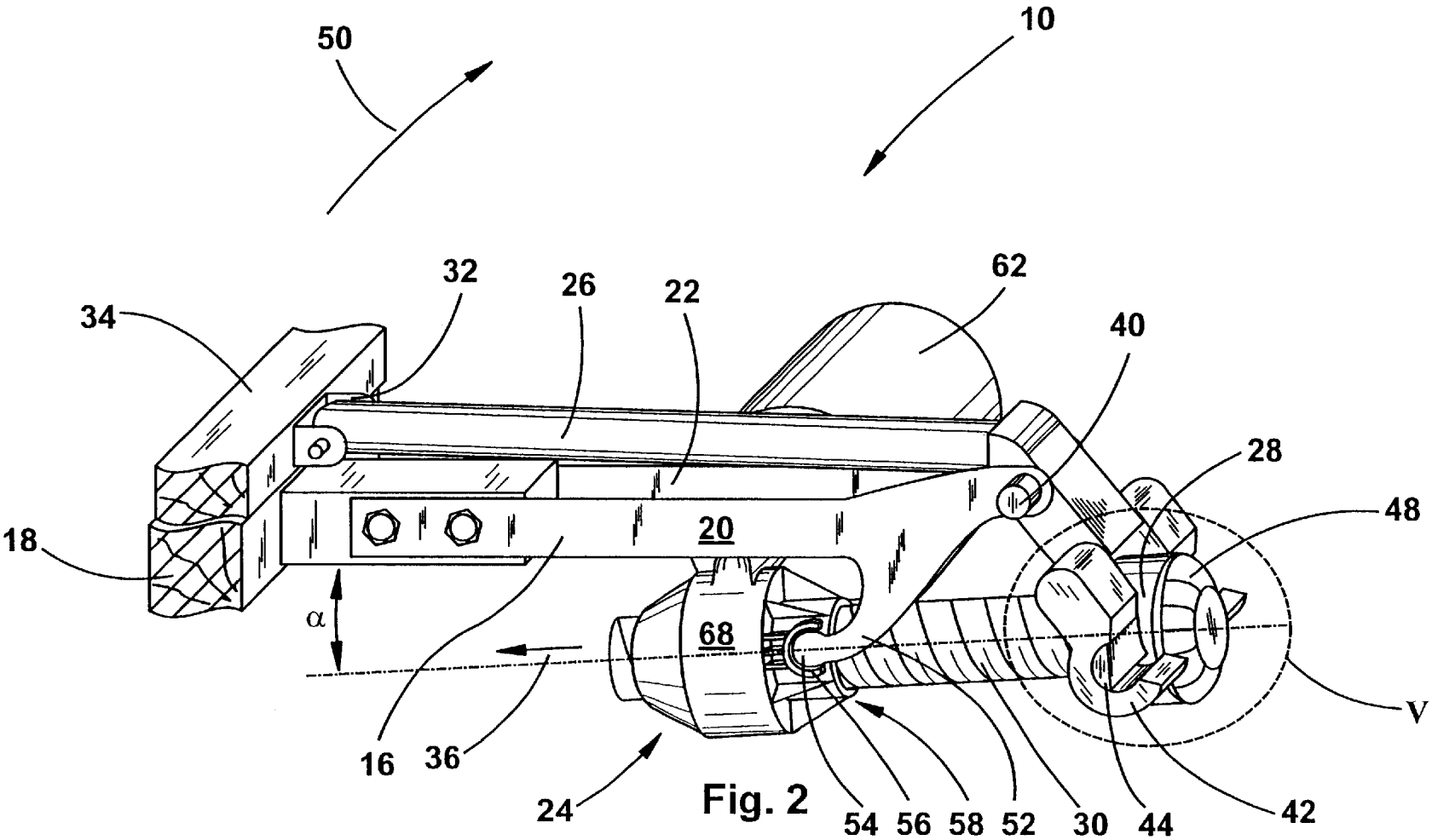
FIG. 2 is a view of the adjusting device according to FIG. 1 in its drawn-in position.
Figure 3:
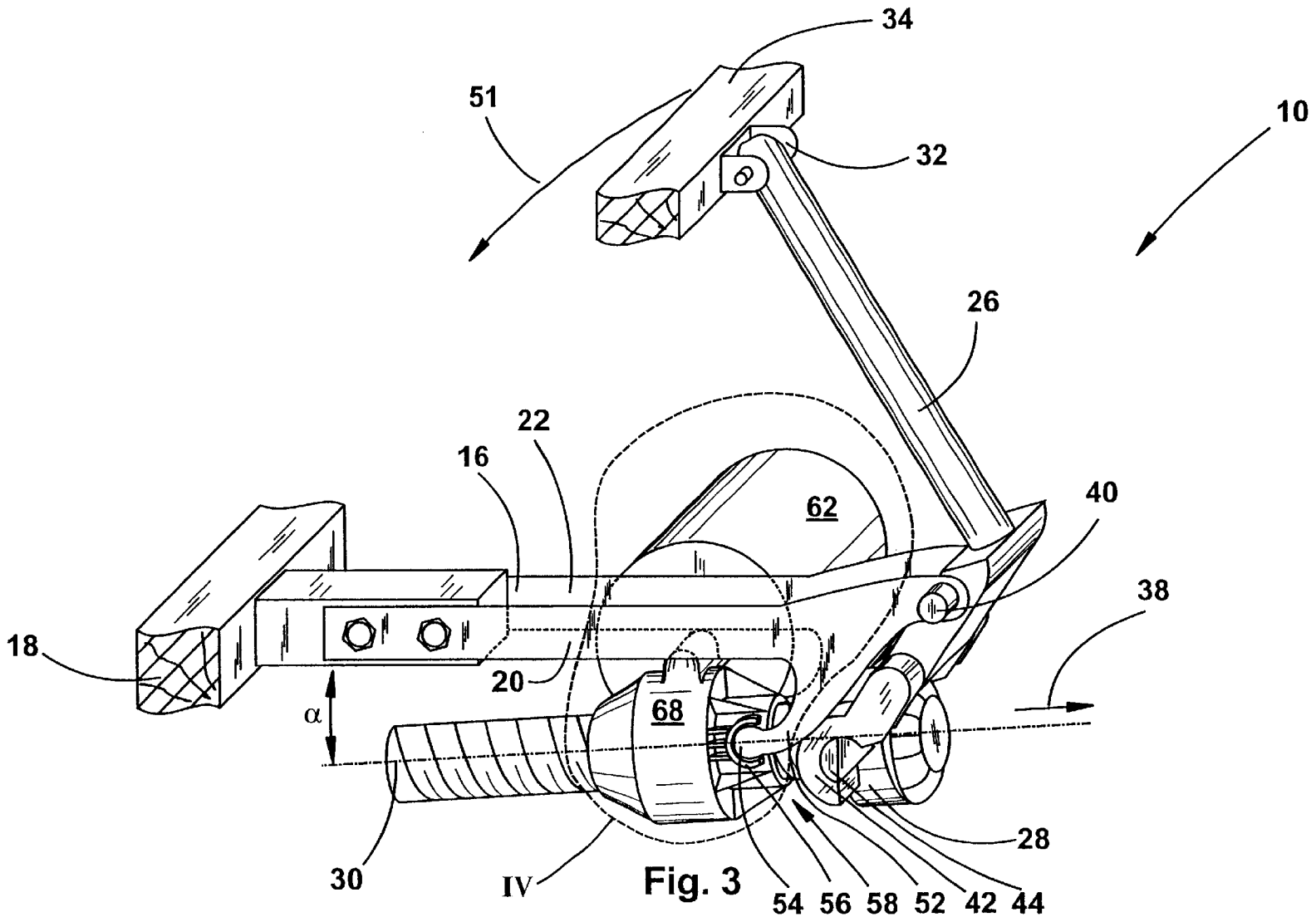
FIG. 3 is a view of the adjusting device according to FIG. 1 in its drawn-out position.

The FIGS. 2 and 3 depict end positions of the adjusting device 10, the adjusting device 10 being completely drawn in in FIG. 2 and being completely drawn out in FIG. 3. The arrows 36 indicates the direction of movement of the spindle 30 relative to the cross-beam 34, to raise the headrest part 12 from the position shown in FIG. 2 to the position shown in FIG. 3. In FIG. 3, the arrow 38 shows the movement of the spindle 30 in the opposite direction.

In the region located above the retaining arm 16, actuating arm 26 is tubular in shape and is bent at a slight angle toward the spindle. In the region of the kink, pins 40 projecting on the right and the left side thereof are provided, wherein said pins may be introduced into corresponding openings in retaining arm 16 in order to pivotally carry actuating arm 26 in retaining arm 16. On its end facing the spindle the actuating arm 26 is provided on its left and right-hand side with grabs 42 that are each shaped like an arc of a circle and that partially surround half pins 44 that are given appropriate size and are projecting from the catch 28. The grabs 42 are thereby dimensioned in such a manner that the rounded region of half pin 44 is surrounded by grab 42 in every position of the actuating arm 26. The clear inside diameter of catch 28 is slightly larger than the outside diameter of spindle 30 so that catch 28 is freely movable alongside spindle 30.

Figure 5:
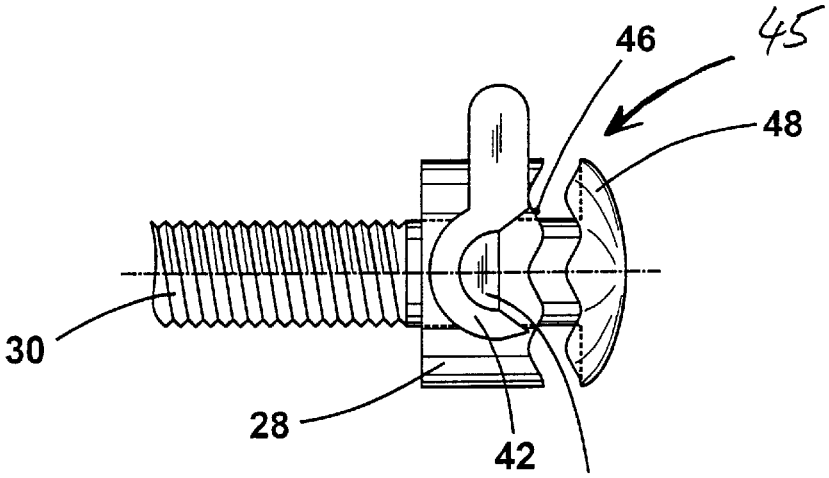
FIG. 5 is an enlarged detail view taken along the line V in FIG. 2.

As can be surveyed in detail from FIG. 5, there is provided a friction clutch 45 between actuating arm 26 and retaining arm 16. The front side 46 of catch 28, which is turned away from the actuating drive, is thereby undulated and corresponds to a buffer 48 arranged on spindle 30. Inasmuch as a load is applied to the actuating arm 26, e.g., the empty weight of headrest part 12 and a person resting thereon, catch 28 is pressed against buffer 48 on account of the lifting forces of actuating arm 26. Now, the undulated front side 46 of catch 28 positively engages buffer 48 and prevents spindle 30 from also rotating. In the event that, on for example lowering headrest part 12, and obstacle gets accidentally caught between supporting framework 14 and headrest part 12, headrest part 12 and accordingly actuating arm 26 remain in this position while the driven spindle 30 continues to move in the direction indicated by arrow 38 according to FIG. 3 so that buffer 48 is moved away from the front side 46 of catch 28. The forces between the actuating drive 24 and the headrest part 12 to be moved are thus interrupted so that a body part has possibly got jammed between headrest part 12 and supporting framework 14 is not further injured by the force of the actuating drive.

A jib 52 is configured on the underside of the cheeks 20, 22, the free end 54 of said jib being cylindrical in shape. This free end 54 engages a corresponding recess 56 of the actuating drive 24, recess 56 surrounding more than 180° of the free end 54, thus forcing a positive and still pivotal holding device 58. The actuating drive that is thus pivotally arranged on the holding device 58 of retaining arm 16 can thus accompany the circular movement executed by the front side end of actuating arm 26 so that, in accordance with the position of actuating arm 26, the spindle 30 is positioned at an angle a relative to retaining arm 16. This angle a is at a maximum at end positions of actuating arm 26 and the angle a is zero degree when the actuating arm 26 is positioned in a mean position that has not been illustrated in the drawing herein.

Figure 4:
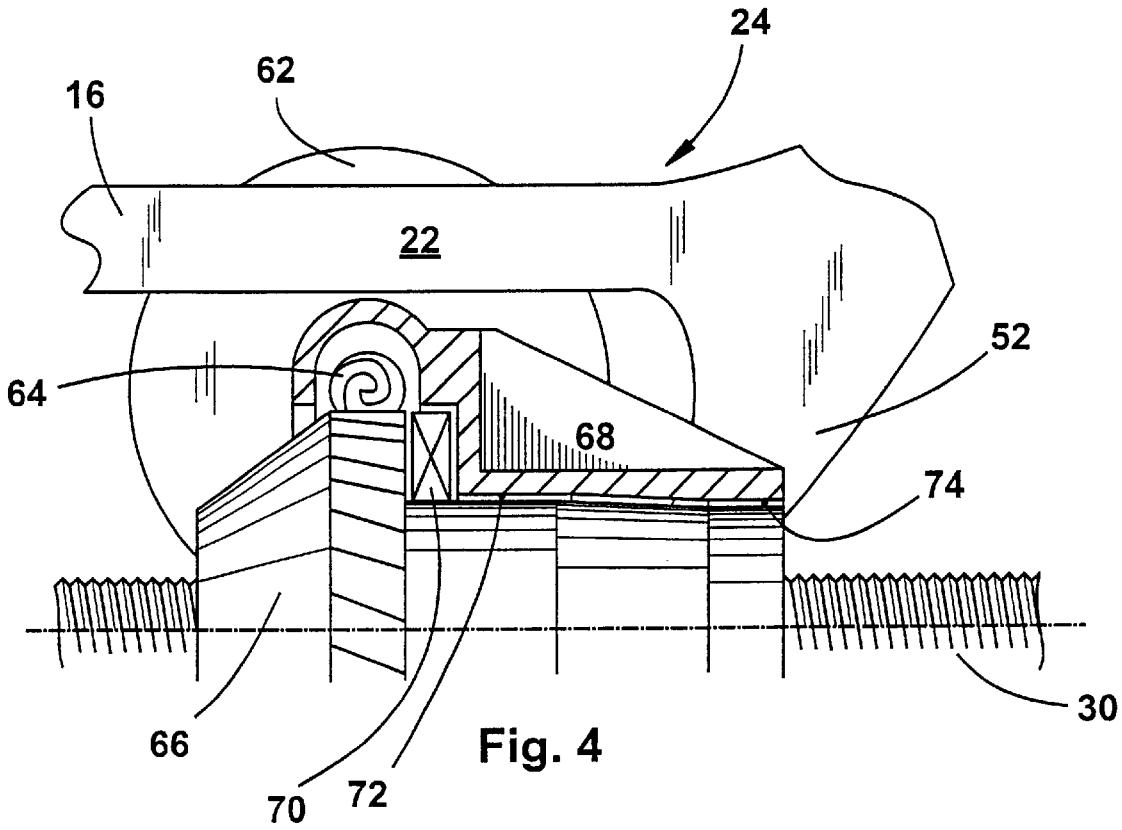
FIG. 4 is an enlarged detail view taken along the line IV in FIG. 3.

As can clearly be seen from FIG. 4, the actuating drive 24 comprises an electric driving motor 62 whose driven shaft is configured as a worm 64. This worm 64 engages a worm wheel 66 that is rotatably carried in a housing 68. The driving motor 62 is also attached on said housing 68 in such a manner that it is prevented from twisting. Worm wheel 66 is arranged coaxially with spindle 30 and engages therewith so that spindle 30 is moved back or forth in axial direction depending on the direction of rotation of the worm wheel.

Between worm wheel 66 and housing 68 there is provided a needle bearing 70 for absorbing the axial forces while two spaced apart sliding bearings 72, 74 absorb the radial forces. On the respective left and right-hand side of housing 68 there is provided one respective radially extending recess 56 into which the free end of jib 52 projects in order for the actuating drive 24 to be pivotally carried on retaining arm 16. Recess 56 thereby surrounds more than 180° of the free end 54 of the jib, thus preventing slipping out and providing a positive and still pivotal connection.

FIG. 2 shows the position of the adjusting device 10 inasmuch as headrest part 12 is neither raised nor drawn out. If headrest part 12 is desired to be elevated, a corresponding control command is transmitted to the electric driving motor 62 so that the worm 64 is rotated in the direction desired. Said worm 64 in turn drives worm wheel 66 that rotates about spindle 30. As a result thereof, spindle 30 is axially displaced in the direction indicated by the arrow 36 in FIG. 2 according to the lead of the thread of spindle 30. Now, buffer 48 of spindle 30 engages the undulated front side 46 of catch 28 and moves the actuating arm 26 in the direction indicated by the arrow 50. Spindle 30 is thereby loaded in tension. As a result thereof, the position of actuating arm 26 is altered, and with it the position of spindle 30 relative to retaining arm 16 since the end of actuating arm 26 that faces the spindle is moved on an orbit. As the actuating drive 24 is pivotally carried in holding device 58, spindle 30 can follow this circular movement of the actuating arm 26, the angle a between the longitudinal axis of spindle 30 and retaining arm 16 changing as a result thereof, though. The meshing of buffer 48 with catch 28 simultaneously prevents spindle 30 from being twisted. After the desired position of headrest part 12 has been reached, the driving motor 62 is stopped and the adjusting device 10 remains in this position. Spindle 30 thereby remains loaded in tension.

If headrest part 12 is to be lowered again, a corresponding impulse to the driving motor 62 causes worm 64 and worm wheel 66 to rotate in the opposite direction so that spindle 30 is moved in the direction indicated by arrow 38 in FIG. 3. Spindle 30 remains loaded in tension on account of the load of the headrest part 12 resting thereon. As a result thereof, catch 28 continues to be pressed against buffer 48, thus preventing spindle 30 from rotating also, which is not wanted. In the event an obstacle gets caught between the cross-beam 18 of supporting framework 14 and the cross-beam 34 of headrest part 12, actuating arm 26 cannot be moved further downward and the still operating driving motor 62 causes spindle 30 to move further in the direction of arrow 38 so that the buffer 48 is now removed from engagement with catch 28. The flow of forces is now interrupted so that the force emanating from driving motor 62 is no longer transmitted to headrest part 12. Only the force resulting from the dead weight of head part 12 is applied to cross beam 34 of headrest part 12. Objects that have got caught accidentally between supporting framework 14 and headrest part 12 are thus prevented from being damaged or body parts that have got caught accidentally between supporting framework 14 and headrest part 12 are thus prevented from being damaged or body parts that have got caught accidentally between supporting framework 14 and headrest part 12 are thus prevented from being injured. After the obstacle has been moved, headrest part 12 will travel back until it reaches the position shown in FIG. 2 or any other position desired.

To arrange the adjusting device 10 vertically in the inner space of supporting framework 14 and to split the bearing loads in one axial needle bearing 70 and in two radial sliding bearings 72, 74 leads to a reduction in the number of component parts and to a smaller size thereof so that the entire adjusting device 10 may be realized so as to save much more space, energy and cost.

Figure 6:
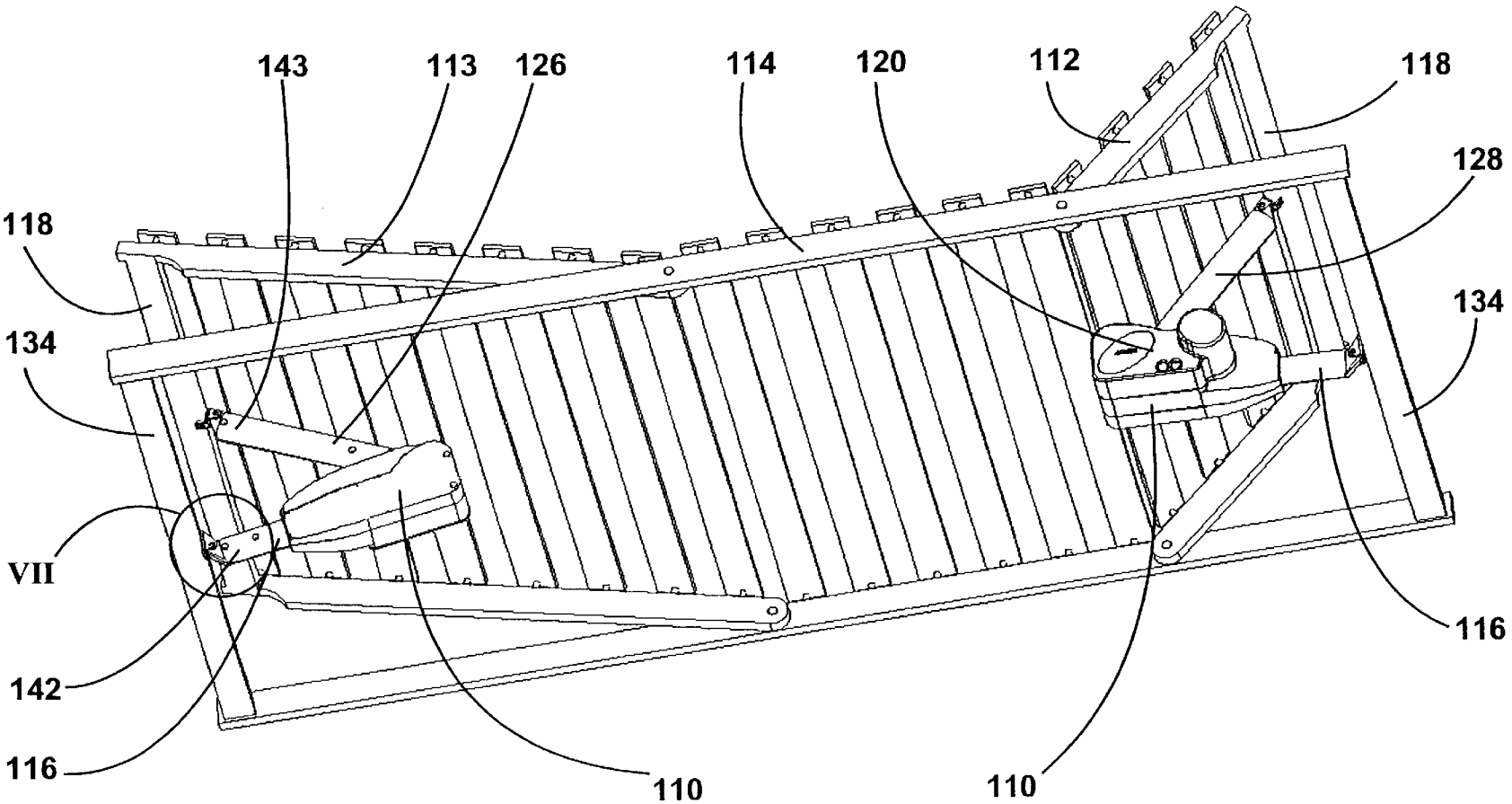
FIG. 6 is a perspective view of a supporting framework of a bed with a second adjusting device in accordance with the invention.
Figure 7:
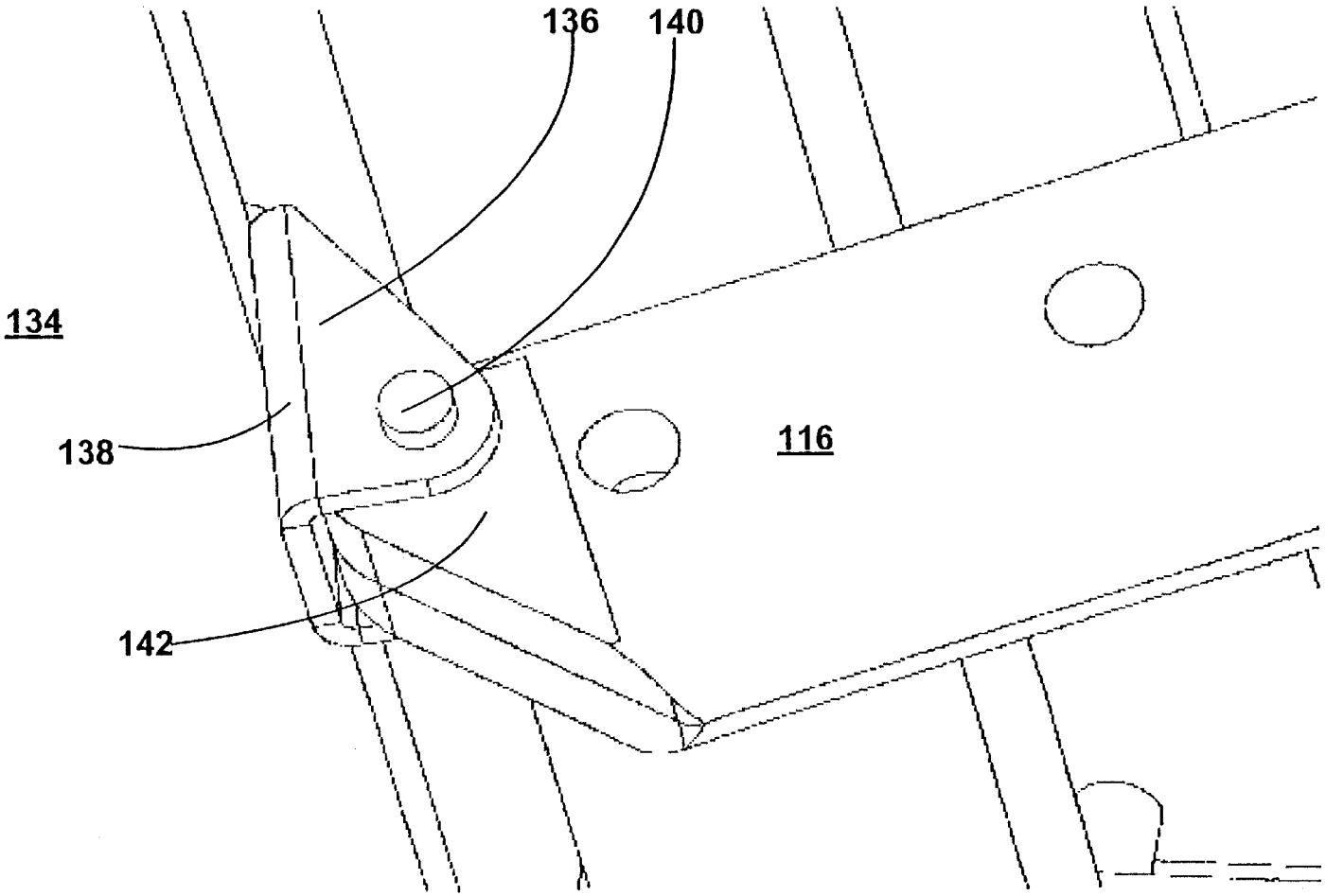
FIG. 7 is an enlarged detail view taken along the line VII in FIG. 6.
Figure 8:
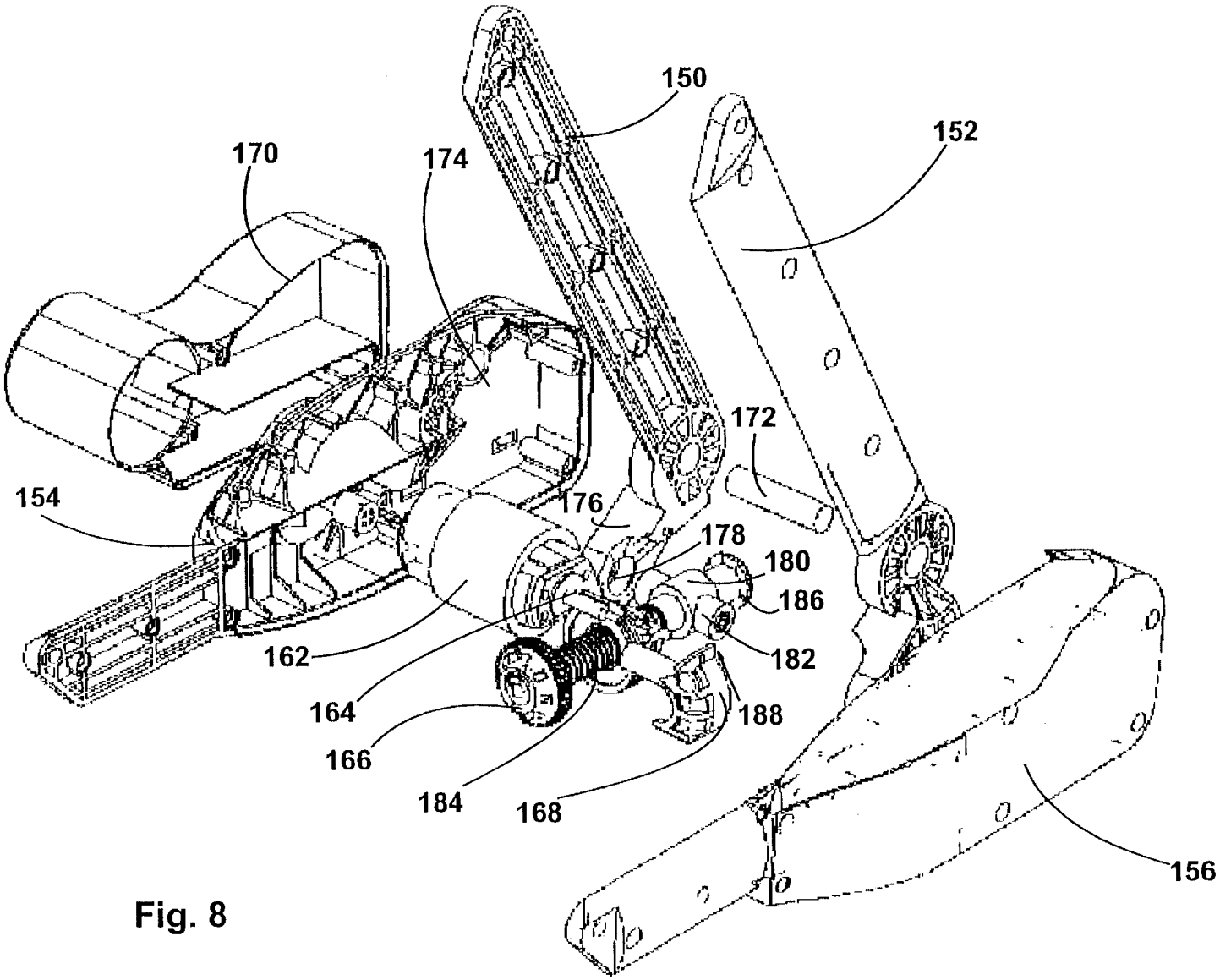
FIG. 8 is an exploded view of the adjusting device according to FIG. 6.

The FIGS. 6 through 8 depict a second embodiment of an adjusting device 110 according to the invention. As can be surveyed from FIG. 6, there is provided one adjusting device 110 for adjusting a respective one of the headrest part 112 and of the leg part 113 relative to a supporting framework 114. The adjusting device 110 comprises a retaining arm 116 and an actuating arm 126, the retaining arm being pivotally attached to a cross-beam 118 of headrest part 112 or of leg part 113, whereas actuating arm 1256 is also pivotally attached to a cross-beam 134 of supporting framework 114. An actuating drive 124 is accommodated in a housing 120 on retaining arm 116, said actuating drive causing retaining arm 116 to move relative to actuating arm 126, retaining arm 116 and actuating arm 126 being arranged in such a manner that they move in one and the same plane. Inasmuch as headrest part 112 or leg part 113 respectively are completely drawn in, retaining arm 116 and actuating arm 126 are lying so close to one another that the angle they form is of only a few degrees. If headrest part 112 or leg part 113 are elevated, actuating arm 126 and retaining arm 116 open so that the angle they form opens as well. This angle can amount to up to 180 degrees.

As becomes apparent from the enlarged detail view in FIG. 7, there is provided on the cross-beam 118 a fitting 138 which has a leg 136 that protrudes forming a U, the protruding legs 138 being traversed by a bolt 140. At the free end of the retaining arm 116 there is provided an opening for receiving the bolt 140 so that the retaining arm 116 may be pivotally arranged on fitting 138 or on cross-beam 134 respectively by way of the bolt 140. The actuating arm 126 is retained in the same manner on the cross-beam 118. This means that the entire adjusting device 110 is pivotally retained by its retaining arm 116 and by its actuating arm 126 on the respective one of the cross-beams 118, 134 by way of the respective bolts 140 only. With this attachment to the supporting framework 114, which is realized by way of bolt 140, no rotation moments but linearly acting forces only can be transmitted from the adjusting device 110 onto the respective one of the cross-beams 118, 134. As a result thereof, the cross-beams 118, 134 are not subjected to such large amounts of strain so that the cross-beams 118, 134, which are customarily made from wood, are capable of transmitting and forwarding the absorbing forces without being damaged in the process.

The adjusting device 110 can be fastened by the free end 142 of a retaining arm 116 and by the free end 143 of an actuating arm 126 to the corresponding cross-beams 118, 134 of the supporting framework 114, the adjusting device 110 extending from the cross-beams 118, 134 into a free space that is available anyway underneath the supporting framework 114. Here, the adjusting device 110 is protected against accidental damage and the risk of injury the operation of headrest part 112 or leg part 113 respectively involves and which consists in having body parts or objects got bruised between the two arms 116, 126 is thus minimized.

Another aspect of the adjusting device 110 that is pivotally attached to supporting framework 114 is that the pivotal retaining arm 116 and the pivotal actuating arm 126 always maintain the adjusting device 110 in a cantilevered position, protruding at right angles from the cross-beam 118, 134 even in the event the headrest part 112 or the leg part 113 are partially or entirely elevated. Although both the retaining arm 116 and the retaining arm 126 have a constant length, the motion lines predetermined by headrest part 112 or by leg part 113 can be executed by the thus arranged adjusting device. The fastening of the adjusting device 110 which is carried out by way of bolt 140 permits the housing 120 to accordingly move up or down so that the adjusting device is provided with sufficient degrees of freedom to be capable of following the predetermined motion path of headrest part 112 or leg part 113.

The structure of this second embodiment of an adjusting device 110 according to the invention is described as follows with the aid of FIG. 8:

The actuating arm 126 is composed of a first shell 150 and of a second shell 152 that can be screwed together. The retaining arm 116 is composed of a first housing half 154 and of a second housing half 156, one end of the actuating arm 126 and the actuating drive 124 being arranged and retained in the housing halves 154 and 156. The actuating drive 154 has a driving motor 162, which is arranged outside the housing half 154 and whose worm 164, which is configured as a driven shaft, extends through housing half 154 and meshes with a worm wheel 166. The entire actuating drive 124 is configured analogous to the actuating drive 24 shown in the first embodiment. Here too, the worm wheel 166 is rotatably carried in a housing 168. The needle and sliding bearings, which have not been illustrated in detail herein, are also arranged analogous to the actuating drive 124 of the first embodiment so that further details regarding the actuating drive may be gathered from the FIGS. 2 through 5 and from the corresponding parts of the description.

The driving motor 122, which is arranged outside retaining arm 116, is covered by a motor housing 170 that may be arranged on housing half 154.

The part of the actuating arm 126 that is located between the two housing halves 154, 156 are provided with recesses for receiving a retaining bolt 172 that engages into corresponding recesses 174 on the inner side of housing halves 154, 156. Actuating arm 126 is pivotally connected to retaining arm 116 by way of said retaining bolt 172.

An angled grab 176 is arranged on the part of the actuating arm 126 that projects beyond the retaining bolt 172, said grab grasping with its opening 178 a pin 182 configured on a catch 180. Said catch 180 is guided on a spindle 184 in such a manner that it is axially slidable and cooperates with a buffer 186 arranged at the end of spindle 184 to form a friction clutch 188. Said friction clutch 188 is configured in a way analogous to the friction clutch 45 of the first embodiment, buffer 186 and catch 180 being also undulated on the respective one of their sides facing the other. Each corresponding surface is hereby provided with eight sinusoidal waves. In order to counter the shear stress with the largest possible surface, the crest and bottom lines of the undulated surface are lying on two planes to which the spindle is perpendicular. Moreover, the waves are steeper toward the axis of the spindle than on the outside.

The motion of rotation emanating from the driving motor 164 is introduced through worm 166 and worm wheel 168 into the spindle 184 in such a way that said spindle is caused to move axially. Again, the friction clutch 188 separates the forces between spindle 184 and actuating arm 126 so that potential risks of injury are minimized.

Listing of numerals:

| | | | |
|---|---|---|---|
| 10 | adjusting device | 110 | adjusting device |
| 12 | headrest part | 112 | headrest part |
| 14 | supporting framework | 113 | leg part |
| 16 | retaining arm | 114 | supporting framework |
| 18 | cross-beam | 116 | retaining arm |
| 20 | cheek | 118 | cross-beam |
| 22 | cheek | 120 | housing |
| 24 | actuating drive | 124 | actuating drive |
| 26 | actuating arm | 126 | actuating arm |
| 28 | catch | 134 | cross-beam |
| 30 | spindle | 136 | leg |
| 32 | angular metal sheet | 138 | fitting |
| 34 | cross-beam | 140 | bolt |
| 36 | arrow | 142 | free end |
| 38 | arrow | 143 | free end |
| 40 | pin | 150 | shell |
| 42 | grab | 152 | shell |
| 44 | half pin | 154 | housing half |
| 45 | friction clutch | 156 | housing half |
| 46 | front side | 162 | driving motor |
| 48 | buffer | 164 | worm |
| 50 | arrow | 166 | worm wheel |
| 51 | arrow | 168 | housing |
| 52 | jib | 170 | motor housing |
| 54 | free end | 172 | retaining bolt |
| 56 | recess | 174 | recess |
| 58 | holding device | 176 | grab |
| 62 | driving motor | 178 | opening |
| 64 | worm | 180 | catch |
| 66 | worm wheel | 182 | pin |
| 68 | housing | 184 | spindle |
| 70 | needle bearing | 186 | buffer |
| 72 | sliding bearing | 188 | friction clutch |
| 74 | sliding bearing | | |

What is claimed is:

1. An adjustment device for pivoting a pivotal element of a piece of furniture in relation to a fixed element of the same, said furniture being used in living and working areas or in the field of health care, with a retaining arm (16), an actuating drive (24) held on said retaining arm (16) and with an actuating arm (26), wherein the retaining arm (16) and the actuating arm (26) are relatively movable, wherein the adjusting device (10) is held on the fixed element (18) via a free end of the retaining arm (16) and on the pivotal element (12) via a free end of the actuating arm (26) and wherein the actuating arm (26) is pivotally connected, via the end thereof situated opposite the free end, to the retaining arm (16).

2. The adjusting deice according to claim 1, characterized in that the retaining arm (16) and the actuating arm (26) are arranged in one plane so as to be pivotal relative to one another in such a manner that the retaining arm (16) and the actuating arm (26) are inclined to one another at an angle ranging from 0° through 180° depending on their position.

3. The adjusting device according to claim 1 characterized in that the retaining arm (16) is rigidly held on the fixed element (18) and that the actuating arm (26) is pivotally held on the pivotal element (12).

4. The adjusting device according to claim 3, characterized in that the actuating arm (26) is held on the pivotal element (12) by length compensating structure (24, 26, 32).

5. The adjusting device according to claim 1, characterized in that the retaining arm (16) and the actuating arm (26) are pivotally held on the fixed element (18) and on the pivotal element (12) respectively.

6. The adjusting device according to claim 1, characterized in that the retaining arm (26) is arranged across the main direction of movement of the pivotal element (12).

7. The adjusting device according to claim 1, characterized in that the actuating drive (24) is held pivotally in relation to the retaining arm (16) or to the piece of furniture by way of a holding device (58).

8. The adjusting device according to claim 7, characterized in that the holding device (58) comprises at least one jib (52) provided with a spherical or cylindrical end (54) that engages with a corresponding recess (56) arranged on the actuating drive (24).

9. The adjusting device according to claim 8, characterized in that the recess (56) extends radially away from the axis of the spindle.

10. The adjusting device according to claim 9, characterized in that the recess (56) surrounds more than 180° of a spherical or cylindrical end (54) of the jib (52).

11. The adjusting device according to claim 8, characterized in that the recess (56) surrounds more than 180° of a spherical or cylindrical end (54) of the jib (52).

12. The adjusting device according to claim 1, characterized in that there is provided a friction clutch (45) between the actuating arm (26) and the retaining arm (16).

13. The adjusting device according to claims 12, characterized in that the friction clutch (45) comprises a catch (28) that is guided on a spindle (30) and rotatably receives the actuating arm (26), the front side (46) thereof, which is turned away from the housing (68), being undulated and said undulated front side (46) being engageable in a correspondingly undulated buffer (48) provided at the end of the spindle (30).

14. The adjusting device according to claim 1, characterized by said actuating drive including a driving motor (62) whose driven shaft is configured as a worm (62), with a spindle (30) that is held in a worm wheel (66) in such a manner that it is axially movable, the worm (64) meshing with the worm wheel (66), and including a housing (68) that carries the driving motor (62) and rotatably accommodates the worm wheel (66), and wherein, between said worm wheel (66) and said housing (68), there is provided at least one needle bearing (70) for absorbing the axial forces and at least one sliding bearing (72, 74) for absorbing the radial forces.

15. The adjusting device according to claim 14, characterized in that two spaced apart sliding bearings (72, 74) are provided on said worm wheel (66).

16. The adjusting device according to claim 15, characterized in that there are provided on the housing (68) two opposite recesses (56) that radially extend away from the axis of the spindle and serve one jib (52) of a holding device (58) each.

17. The adjusting device according to claim 16, characterized in that the recess (56) surrounds more than 180° of the spherical or cylindrical end (54) of the jib (52).

18. The adjusting device according to claim 14, characterized in that there are provided on the housing (68) two opposite recesses (56) that radially extend away from the axis of the spindle and serve one jib (52) of a holding device (58) each.

19. The adjusting device according to claim 18, characterized in that the recess (56) surrounds more than 180° of the spherical or cylindrical end (54) of the jib (52).

* * * * *

UNITED STATES PATENT AND TRADEMARK OFFICE

CERTIFICATE OF CORRECTION

PATENT NO. : 6,687,932 B1
DATED : February 10, 2004
INVENTOR(S) : Bangert et al.

It is certified that error appears in the above-identified patent and that said Letters Patent is hereby corrected as shown below:

Title page,
After Item "[87] PCT Pub. No.: WO 00/67617" please insert, the following:
-- [30] Foreign Application Priority Data
May 7, 1999 (DE) 199 21 300.3 --

Column 1,
Line 4, should read -- This application is a Continuation of PCT/DE00/01433 filed May 8, 2000 and claims priority from German Patent Application No. 19921300.3 filed May 7, 1999. --

Signed and Sealed this

Twenty-second Day of June, 2004

JON W. DUDAS
*Acting Director of the United States Patent and Trademark Office*